US008848487B2

(12) United States Patent
Eylon-Azoulay

(10) Patent No.: US 8,848,487 B2
(45) Date of Patent: Sep. 30, 2014

(54) NONLINEAR TIMER

(76) Inventor: Tidhar Eylon-Azoulay, East Binyamin (IL)

( * ) Notice: Subject to any disclaimer, the term of this patent is extended or adjusted under 35 U.S.C. 154(b) by 600 days.

(21) Appl. No.: 12/737,614

(22) PCT Filed: Jun. 30, 2009

(86) PCT No.: PCT/IL2009/000650

§ 371 (c)(1),
(2), (4) Date: Mar. 29, 2011

(87) PCT Pub. No.: WO2010/013230

PCT Pub. Date: Feb. 4, 2010

(65) Prior Publication Data

US 2011/0170379 A1 Jul. 14, 2011

(30) Foreign Application Priority Data

Jul. 28, 2008 (IL) ..... 193086

(51) Int. Cl.
*G04B 19/00* (2006.01)
*G04G 9/02* (2006.01)
*G04B 19/08* (2006.01)

(52) U.S. Cl.
CPC . *G04G 9/02* (2013.01); *G04B 19/08* (2013.01)
USPC ..... 368/14; 368/76; 368/223

(58) Field of Classification Search
USPC ..... 368/14–15, 28, 223, 76
See application file for complete search history.

(56) References Cited

U.S. PATENT DOCUMENTS 4,512,667 A 4/1985 Doulton et al.
5,619,477 A * 4/1997 Schenk ..... 368/10
5,724,316 A * 3/1998 Brunts ..... 368/10
6,040,808 A 3/2000 Knox et al.
6,172,941 B1 * 1/2001 Bieramperl ..... 368/10
6,304,519 B1 * 10/2001 Druk ..... 368/107
6,359,839 B1 * 3/2002 Schenk et al. ..... 368/16
6,826,121 B1 * 11/2004 Olexa ..... 368/10
6,901,032 B1 5/2005 Eo et al.
7,218,575 B2 5/2007 Rosevear
8,230,345 B2 * 7/2012 Rosenshein et al. ..... 715/733
2005/0135195 A1 * 6/2005 Kreidler ..... 368/107
2006/0291333 A1 * 12/2006 Kostura ..... 368/15
2007/0139417 A1 6/2007 Hoddie et al.
2008/0008049 A1 1/2008 Landsberg (Continued)

FOREIGN PATENT DOCUMENTS

WO WO 85/01805 4/1985
WO 97/07436 2/1997

OTHER PUBLICATIONS

International Search Report for PCT/IL2009/000650, mailed Oct. 20, 2009.

*Primary Examiner* — Sean Kayes
(74) *Attorney, Agent, or Firm* — Nixon & Vanderhye P.C.

(57) ABSTRACT

A Nonlinear Timer apparatus characterized by having a display indicator (e.g. hands) with a large plurality of respectively contiguous perceived velocities, said indicator being configured to include predetermined non-zero acceleration for substantially any contiguous intermediate plurality of said respective indicator velocities. The apparatus is for portraying substantially nonlinear temporal frames of reference that are more honestly scaled to the individuals' respective circumstance than to the metronome mechanical tempos of industrial world time-clocks. However, the Nonlinear Timer apparatus is preferably represented according to classical concentrically rotating clock hands; digital or analog.

19 Claims, 5 Drawing Sheets

(56) References Cited

U.S. PATENT DOCUMENTS

2008/0212415 A1* 9/2008 Nagao ..... 368/204
2009/0050458 A1* 2/2009 Tukachinsky ..... 200/35 R
2009/0122652 A1* 5/2009 Parees et al. ..... 368/10

* cited by examiner

NONLINEAR TIMER

This application is the U.S. national phase of International Application No. PCT/IL2009/000650 filed 30 Jun. 2009, which designated the U.S. and claims priority to Israeli Application No. 193086, filed 28 Jul. 2008, the entire contents of each of which are hereby incorporated by reference.

TECHNICAL FIELD

The present invention generally relates to time keeping. More specifically, the present invention relates to calculating and displaying nonlinear time components.

BACKGROUND ART

There is a longstanding problem of providing accurate calculations for generic temporal systems; having innate nonlinear components. In the most critical aspect, the problem is to transform the cumulative temporal intervals from these calculations to display representations that are easily recognized and properly interpreted.

Linear time calculations come to us from the simplified models of the Babylonians (360 degrees in a circle, 60 portions per degree, etc.), from the Earth centric astronomical models of the Greeks, and even from the early circular motion Copernican models. However, modern temporal models have incorporated (1) elliptical planetary motions and (2) higher order complexity in substantially cyclic patterns for the "biological clock"—which in turn are not properly represented using the simpler low-order cyclic-based metrics.

For example, the length of a winter day (between sun rise and sun set) is different than that of a summer day; and the length of minutes within those respective days should not be of equal duration—if one divides the day into the ordinary understanding 12 hours of day and 12 hours of night (e.g. called Temporal Hours).

Because the standard technological time intervals (hours, minutes, and seconds) are of standardized duration, often individuals (who run on biological time—of course) feel that some hours are passing quickly while others just drag very slowly. Certainly, there are components of the individual's activity and attention that dominate this perception of inhomogeneous interval duration, but biological time is certainly a component too.

Biological time, the true anthropomorphic time for the individual, seems to be convolved from multiple components. Solar and Lunar cycles, as perceived from the person's respective latitude and longitude, would seem to be dominant variables. Thereafter, seasonal factors, other astronomical factors, and local personal circumstances should all be considered—if they can be correctly quantified, or at least properly approximated. Other factors that may require consideration are personal age, gender, mental development, maturation, dietary influences on metabolic activity, scheduled and unscheduled medication ingestion, emotional or physical trauma, and the like. Simply stated, there is a need for temporal systems wherein nonlinear calculations are necessary and wherein nonlinear representations are advantageous; even if some aspects of these are not conducive to interpersonal event scheduling—such as business appointments. On the other hand, some aspects of these nonlinear calculations and respective representations may be more conducive for interpersonal events—such as sexual activity, sports matches, rest periods between physical or mental activity sessions, and the like.

Accordingly, there is a longstanding need in the chronometric arts for improved methods and devices that compute nonlinear temporal systems' metrics and that preferably represent them in instantly recognizable and easily interpretable formats; such as a standard clock face with hands—repeating 12 hour intervals; or the like.

Turning now to the prior art, various attempts to present astronomical data on a standard timer and principally the movement of the sun, remained limited only to informative displays of the location of the sun or other celestial bodies on the dial of the standard timer without converting the length of the day or night to a substance of its own being displayed in an equal and uniformed manner on the timer, and without changing the rhythms of the timer. Ideas of this sort are seen in patents that integrate astronomical data in a standard timer as set out below:

U.S. Pat. No. 6,901,032—Timepiece from which sunrise and sunset time can be determined, shows on a dial of 24 hours, the length of the daylight time by indicating the time of the sunrise and the sunset in the background of the dial of hours, so that one can see the daylight time portion of the day on the timepiece. U.S. Pat. No. 7,218,575—Angular twilight clock, shows the period of time from dawn to sunrise, or from sunset to nightfall by shading the background of the dial of hours in a pie-slicing manner of the abovementioned time periods, in this manner an indication of the elevation of the sun at the beginning or at the termination of the day, by an indication of the hues of the cap of the sky, are obtained.

While these devices fulfill their respective, particular objectives and requirements, the aforementioned patents do not satisfy the need to convert a length of time to a substance of its own, and to change its rhythms.

U.S. Pat Pub 2008/0008049—Synclecron timekeeping apparatus, deals with temporal hours. This application shows "natural time" of the "natural" day and night, that is by dividing the whole solar day into two parts at sunrise and sunset, and by dividing each of them into 12 "natural" hours of the local day and night. Likewise this apparatus shows the relative passage of time from the beginning of the natural day or night by rotating an inner hieroglyph circle that completes one full cycle during one "natural" day or night and by coloring the background behind the hieroglyph circle this in purpose to show the natural solar passage of time in a relativistic manner in relation to the length of the "natural" day or night, needed for chronotherapy or chronobiology applications. In addition the point of origin of the dial of hours of the synclecron is at the bottom of the dial, so that the moment of midday and midnight are located at the top of the dial.

Accordingly, there remains a need in the art for a fundamentally different timer which can portray by way of clock-hands interval segments, changing from time to time.

There is a need for a user, managing a particular way of life according to a particular nonlinear model (for example the user of the "Jewish-Law" nonlinear model or a user of the Muslim nonlinear model, etc.) to have the customary standard view of the analog dial clocks utilizing hands (passing 30 degrees per hour, etc.) in order to indicate an exact temporal time, whether during the day or the night of the user. A general daily movement of hieroglyphs is inappropriate for that need.

Furthermore for a "Jewish-Law" user, there is a longstanding need for a dynamic adaptation to the temporal Jewish-Law solar model. This model divides the whole solar day into two parts called the Jewish-Law Day and Night, which exist between any two astronomical points on the diurnal solar arc and not necessarily between the local sunrise and sunset points. Accordingly these hours are not "natural" but "temporal" defined in accordance with the division specifications of the Jewish-Law interpretation. The prior art does not address this need.

The background layer beneath the traveling elements of the Synclecron apparatus is colored in a certain shade in order to illustrate the celestial daily state, whereas for the user of a particular nonlinear timer, there is a need to portray on its display, time periods illustrated via colored slices or to show specific moments by placing icons, and not to show a general situation.

For a "Jewish-Law" user, there is a need to maintain the custom that the beginning or termination of the "Jewish-Law" day or night is at the top of the dial of hours, at hour 12:00, the "Zero-Hour" and that midday and midnight are at the bottom of the dial of hours at hour 6:00.

From all of the foregoing, it is obvious that the prior art does not address the spirit and scope of the needs of users managing a way of life according to a nonlinear time model.

SUMMARY OF THE INVENTION

The aforesaid longstanding needs are significantly addressed by embodiments of the present invention, which specifically relates to a Nonlinear Timer; most particularly for an exemplary use as a "Jewish Law" Timer. The instant apparatus is especially useful in man-computer interactions wherein there exists a facile ability to provide proper perception formats that are accurate in the context of the less geometric and more organic complexities of man centric temporal frames of references. Simply stated, just as we have progressed from earth centric to sun centric models, there is an ongoing need to progress from astronomical centric time to individual personal time—or at least to temporal frames of reference that are more honestly scaled to the individuals' respective circumstance.

The instant invention (better appreciated in the conjunction with a study of FIG. 1) relates to embodiments of an Nonlinear Timer apparatus comprising: (A) an electronic processor [100] running a predetermined program [110] , said processor having (i) an internal clock [120] configured for producing evenly paced signals, (ii) an input stage [130] capable of accepting a geographical position calibration and a calendar calibration and a clock calibration, and (iii) a calculator stage [140] capable of real-time calculating at least one respective current temporal interval using the internal clock in conjunction with substantially all of the calibrations of the input stage; and (B) a displayer [200] interconnected [210] to the processor, said displayer having (i) a display driver stage [220] capable of modifying a display setting using the at least one respective current temporal interval, and (ii) a presentation stage [230] capable of presenting a respectively modified display setting.

The predetermined program coordinates with the calculator stage to compare an accounting between the ongoing internal clock and an apparatus specific (or elected or user defined) time model for portraying nonlinear interval segments in conjunction with substantially all of the calibrations of the input stage; thereby pacing the display according to a locally nonlinear model that uses the calibrations—such as actual day and night times in a specific location at a specific date, actual personal metabolic (e.g. diet related specifics) or personal hormonal time.

According to one aspect of an instant embodiment, the input stage capable of accepting a geographical position calibration includes a user interface accepting at least one data item selected from the list: a nearest city, a country, a GMT (Greenwich Mean Time) related time zone, a latitude, a longitude, and a Global Positioning System signal.

According to another aspect of an instant embodiment, the input stage capable of accepting a calendar calibration includes a user interface accepting at least one data item selected from the list: a national calendar date, a religious calendar date, a cultural calendar date (e.g. according to Jewish chronology, Islamic chronology, Japanese chronology, or the likes), a personal biological calendar date, an agricultural calendar date, a species specific physiological calendar date, a weather event calendar date, an econometric model calendar date, and a predetermined interpretation of any of the aforesaid.

According to a further aspect of an instant embodiment, the input stage capable of accepting a clock calibration includes a user interface accepting at least one data item selected from the list: a GMT correlated clock reading and another Nonlinear Timer apparatus correlated clock reading.

According to yet another aspect of an instant embodiment, the calculator stage capable of real-time calculating at least one respective current temporal interval includes computation of a display indicator velocity component usable by the displayer for the modifying of a display setting. According to a preferred variation of this aspect, the calculator stage computation of display indicator velocity components is configured to include a non-zero acceleration for substantially any contiguous intermediate plurality of said respective indicator velocity components. On the ordinary scale of perception, timer hands will move faster at certain parts of the day and slower at others.

According to still a further aspect of an instant embodiment, the displayer presentation stage includes a display module selected from the list: flat digital display, rotating analog indicator, and a combination of the aforesaid. According to a preferred variation of this aspect, the displayer presentation stage includes a display module configured to display at least one item selected from the list: an icon, an alert, an alarm, and a reminder; and the location of each respective at least one item is positioned in coordination with an orientation of a visible indicator. Of course, the inventor also contemplates audio output, tactile output, and vibrations in conjunctions with various embodiments of the displayer.

Furthermore, according to a preferred instant embodiment the calculator stage includes parameters of a predetermined substantially nonlinear temporal model (e.g. actual real solar time divided into 50% day and 50% night for each ordinary GMT clock 24 hour cycle—albeit potentially corrected for seasonal perturbations) and said parameters are used in the real-time calculating. While the instant inventor conceives that using the internal clock in conjunction with substantially all of the calibrations of the input stage is already sufficient to cause local temporal interval irregularities—sequentially nonlinear in specification, there may be redundantly mundane models which intentionally retrofit the calibrations to produce linear temporal representation; thus the using of the calibrations to accomplish a nonlinear result is preferred—in that it is the pith and marrow of the objective purposes of the instant invention and of all of its embodiments! Alternatively, the reader may correctly consider the predetermined substantially nonlinear temporal model to be substantially equivalent to the aforementioned predetermined program (running on the electronic processor). Now, simply stated, embodiments of the instant invention are for the purpose of a simple to appreciate displayer, giving information to the user in a simple format that is easy to understand. Driving the displayer is a processor having a program which substantially relates to higher order factors which in turn cause the displayer to present information which seems to sometimes progress quickly and at other times progress more slowly. The actual presentation variations will depend on the fundamental premise of the program being for a discrete time model or for a higher resolution substantially continuous model. In the discrete model, variations of display indicator velocity may be changed every minute or every hour or every few hours; while in the continuous model the velocity may be updated with each new motion of the indicator.

Now please note that there are great multiplicities of other exemplary nonlinear temporal models, of which we will now catalog an illustrative few. The female menstrual cycles (and other physiologically measurable parameters) typically include various Fourier components within a larger (longer duration—e.g. annual, decade, etc.) envelopes of re-calibrations events. This description is also reasonably true for financial market models, weather (including day, night, seasonal, and longer cyclic components), lunar observations which include solar influences typically precluding ordinary lunar observation, locusts' circadian systems, and the like. Accordingly, just as modelers have applied concepts like momentum to zero-mass data, likewise the instant invention presents nonlinear time portrayal for data series—as a more anthropomorphically understandable for temporal-sequence presentations.

Yet another embodiment of the instant invention relates to having physical or graphical hand to indicate time or a time significant aspect (e.g. season, moon phase, bio rhythm, etc.) and the apparatus preferably has a digital display background to at least one substantially cyclically orbiting indicator element (e.g. physical or graphical hand) wherein the background includes at least one icon and is characterized by a user interface that accepts setting position of the at least one icon. (In this context, the positions and interpretations of the icons are preferably understood by the user in relations to their respective locations on the displayer. Icons may be automatically placed by the predetermined program and/or by the user for personal reminders, or the likes.) Specifically, the at least one substantially cyclically orbiting indicator element is typically three hands (if in analog) or three hand-representations (if in digital)—most typically respectively for hour, minute, and second. Nevertheless, there are other timepieces that have hands for aspects of body rhythms, astrological positions, and the likes. In this context, it should also be noted that the present invention Nonlinear Timer apparatus is characterized by having a display indicator with a large plurality of respectively contiguous perceived velocities, said indicator being configured to include predetermined non-zero acceleration for substantially any contiguous intermediate plurality of said respective indicator velocities.

BRIEF DESCRIPTION OF THE DRAWINGS

In order to understand the invention and to see how it may be carried out in practice, embodiments including the preferred embodiment will now be described, by way of non-limiting example only, with reference to the accompanying drawings.

Furthermore, a more complete understanding of the present invention and the advantages thereof may be acquired by referring to the following description in consideration of the accompanying drawings, in which like reference numbers indicate like features and wherein.

DESCRIPTION OF THE INVENTION

Figure 1:
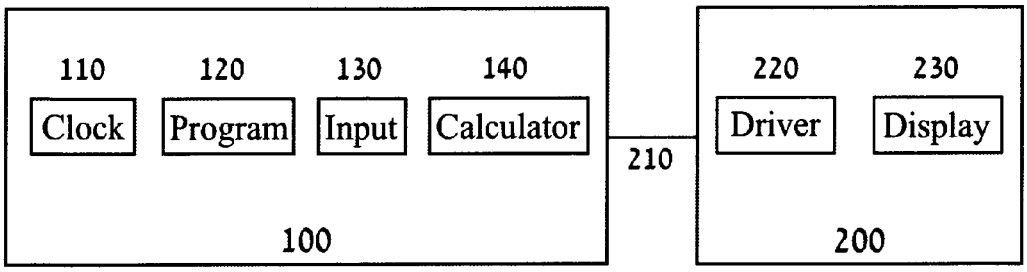
FIG. 1—is a schematic structure of an embodiment of the invention.

There are various nonlinear time models which may be implemented as embodiments in the Nonlinear Timer invention by way of appropriate defined programs, which constitute the nonlinear temporal model of the invention. The most important model amongst them for the inventor is the Jewish Time Model. In particular, when this model is applied to the Nonlinear Timer, a true Jewish timer is achieved, what shall hereinafter be called a "Jewish-Law Timer". This Timer has several embodiments; the best embodiment from the user point of view is the embodiment that includes the all of the "Jewish Law" features.

Furthermore there are other nonlinear models such as those described in the background section that can be implemented by the user of the Nonlinear Timer, such as the Muslim, Chinese, Bio-Rhythm and the like that the user might desire to use.

Jewish Time Model

In the Jewish religion the length of the day and the night are fixed according to the daily course of the sun above and beneath the cap of the sky which is referred to as the "diurnal arc". Because the period of light-time in the course of the solar day varies from day to day and from location to location, the day and the night also vary which brings the division of the solar day into two not necessarily equal time periods called: the Jewish-Law Day and the "Jewish-Law Night". The Jewish-Law Day and the Jewish-Law Night are each divided into 12 hours, which causes the hours to lengthen and shorten according to the seasons of the year and the location of the user on the earth. These hours are called temporal hours as their duration varies from time to time, such that the rhythms of time in Judaism are re-set at every transition from the Jewish-Law Day to the Jewish-Law Night.

This model of time is important to the Jewish people because of the duty in Judaism to pray three prayers a day: the Morning Prayer "Shacharit", the afternoon prayer "Mincha" and the evening prayer "Arvit". These are dependent on the Jewish-Law temporal hour definitions whether during the Jewish-Law Day or the Jewish-Law Night. Likewise, the duty to read twice a day the "Hear O Israel" Portion of the Bible at its "Jewish-Law" defined time is according to the temporal hours. In this way all of the events for the Jewish people such as Jewish Holidays and other dates in the Jewish calendar are temporal hour dependent.

A founding principle of the Jewish Time Model is that a nucleus of the Jewish-Law Timer embedded program is given the basic settings of the input stage: local time, date, location. The default setting or user settings of the Jewish Time Model, enable calculation of the exact time rhythms and the velocity of the hands, in the calculation stage of the Nonlinear Timer at every moment. Ultimately this data can be presented on the displayer of the timer.

The idea of the Jewish-Law Timer is to allow the use of temporal hours which are a function of the daily astronomical course of the sun. Accordingly the Timer must be correlated with the data of the user, that is: the local time, the date, the geographical position and the landscape of his location, as they affect the daily apparent rotation of the celestial bodies visible to man. This issue will be explained in the "Definition of the Diurnal Arc" section.

The user must define the Jewish-Law Day and Night which he is accustomed to according to the Jewish-Law, and since the astronomical course is known it is possible to identify the moment of time at which the Jewish-Law Day and Night start and end in the course of the whole solar day. This will be explained in the "Definition of the Jewish-Law Day and Night" section.

When these moments of time are determined, the duration of the Jewish-Law Day and Night can be calculated, as well as the temporal duration of their Hour, Minute and Second, this issue will be explained in the "Calculation of the Temporal Hours Rhythms" section.

With aforementioned data, the temporal hours can be displayed in a circle of hours in the same way as displayed on a standard clock, however the velocity of the hands is calibrated to the rhythms of the temporal hours—this will be explained in the "Adaptation of Temporal Hours to the Standard Timer" section.

When the Jewish-Law Timer is in operation, it is possible to display various backgrounds which relate to events occurring in the aforementioned temporal hours frame model. This will be explained in the "Background Layers" section.

Finally there are derived applications that integrate harmoniously in the Jewish-Law Timer, for example calendars and their special events, this will be explained in the "Application of the Jewish-Law Timer in the Nonlinear Timer" section.

Definition of the "Diurnal Arc"

The Jewish-Law Timer is adapted to variations in the length of the light-time and dark-time in a 24 hour day, as a function of the location of the user on the earth, the local time, and the date (data of the user). We will first define the astronomical premise upon which the data of the user is based.

The orbit of the earth around the sun, its angle of inclination in relation to the plane of this orbit, the precession of this angle, and its daily rotation around its axis, cause the observer on earth to view the sun in its daily motion rising from his east, arching across the cap of the sky, setting west of the observer and moving to complete the arc below the heavens of the observer until its rising from his east on the following day. This motion in the form of an arc will hereinafter be called the "Diurnal Arc", and it is sufficiently prevalent in the horizontal (topocentric) coordinates system.

Figure 2:
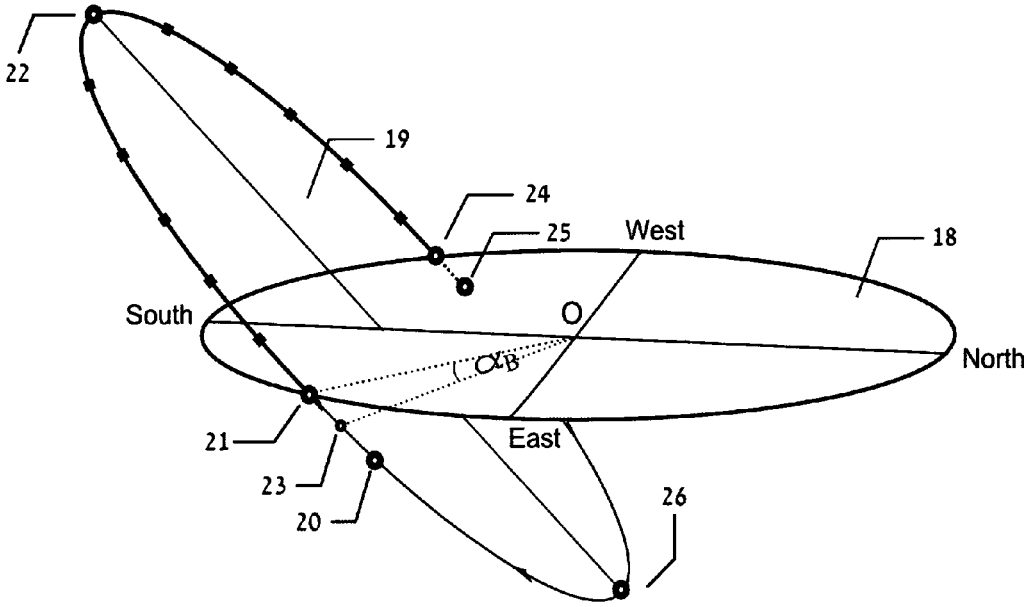
FIG. 2—presents the origin of the nonlinear time model of the "Jewish-Law" Timer.

FIG. 2 describes a particular daily course of the sun in the Diurnal Arc [19] in the winter season relative to a given point O on the earth. Point O is fixed on the plane of the observer's location [18], which is the plane that is perpendicular to the vector of gravity of earth, in the observer's location at point O. The crossing points between the planes are the astronomical sunrise [21] and sunset [24] called R and S respectively, in the Diurnal Arc, point D [20] and point N [25] are located where the sun is 20° below the horizon of the observer, prior to the sunrise and following the sunset, are respectively called "dawn" and "dusk". Point Z [22] constitutes the daily climax point (the zenith) at which the sun is at its highest elevation in the diurnal arc, and point M [26] is the lowest point (the nadir) which is 180 degrees therefrom on the Diurnal Arc.

The time it takes for the sun to move from the zenith and back to the same point is called the "Solar Day" and its length varies from day to day such that one can define it as a function of the date. This variation is known as the "Equation of Time".

The inclination and the offset of the Diurnal Arc relative to the plane of the observer's location is dependent on the geographical location of the observer and on the season (the date). Accordingly, in order to calculate the Diurnal Arc it is necessary to input into the Jewish-Law Timer the following data of the user: location, i.e. longitude and latitude, time zone, date, standard time, and daylight savings time (summer/winter), if applicable.

From the moment such data has been defined by the user, the Jewish-Law Timer performs a number of astronomical calculations in order to calculate the exact location of the sun in the Diurnal Arc, these calculations constitute the $\Phi_{sun}$ algorithm which allows the calculation, for any given elevation angle $\alpha$ where the sun is located in the Diurnal Arc [23], what the exact moment $T_\alpha$ is, when the sun will be located there, according to the standard conventional time of the user. The algorithm takes the elevation and the zone in the Diurnal Arc (before or after the zenith AM, PM) where the definition of the elevation is required for the calculation. This algorithm serves as the basis for the calculation of the aforementioned temporal hours. The algorithm for calculation the Diurnal Arc of the sun is called: $T_\alpha=\Phi(\alpha, \text{Zone})$ [Hour]. We note that the formula and calculation of the algorithm $\Phi_{sun}$ is not contained in the present document. It is emphasized that the unit of time of this algorithm is the regular standard conventional time and therefore indicated as a regular unit of time [Hour].

The Definition of the Jewish-Law Day and Night

The Jewish-Law Day in Judaism depends on different Jewish-Law interpretation methods, and so its definition depends on the user of the Jewish-Law Timer. The Jewish-Law Timer is adapted to all possible definitions of the Jewish-Law Day and Night, as may be defined according to the Jewish Law interpretation methods. The user is required to choose the exact Jewish-Law Day interpretation which he customarily follows.

The definition of the Jewish-Law Day is accomplished by fixing its starting point elevation $\alpha_B$ and its termination point elevation $\alpha_E$ on the Diurnal Arc. The starting moment of the Jewish-Law Day $T_B$, according to the different Jewish-Law interpretation methods ranges from the moment the sun is located on a given point $\alpha_B$, between the dawn D and the zenith Z, see FIG. 2 [23], and the termination moment of the Jewish-Law Day $T_E$ ranges from the moment the sun is located at a certain point $\alpha_E$ on the Diurnal Arc between the zenith Z and the dusk N. The period of time $T_B$-$T_E$ is the Jewish-Law Day, and the portion which makes it a complete solar day is the aforementioned Jewish-Law Night. Therefore, the Jewish-Law Night will be in any case defined as the portion added to the Jewish-Law Day to complete a full Solar Day. The entry of these elevations into the algorithm $\Phi_{sun}$ gives the moments $T_B$ or $T_E$ which constitute the starting and termination moments of the Jewish-Law Day in the complete Solar Day.

There are Jewish-Law interpretations in which the Jewish-Law Day and Night are defined not only according to the elevation on the Diurnal Arc but also according to an "Offset Time" from these elevation angles. Such that the definition of the beginning and termination of the Jewish-Law Day shifts from the aforementioned moments $T_B$ or $T_E$ during a certain period of time $\beta_B$, $\beta_E$. This offset time according to Jewish-Law interpretations can be in equal hours or in temporal hours of the particular day, however the points $T_B$ and $T_E$ that shift in a period of time are based on the moments of time derived directly from the Diurnal Arc and will be redefined as $T_{BS}$ and $T_{ES}$.

Turning to Default Options, Two widespread Jewish-Law interpretations exist as the default option of the Timer; Dawn to nightfall (end of dusk) interpretation: the times of the dawn and the nightfall are defined according to 3 possible interpretations (relatively to the elevation of the sun beneath the horizon) 3.65 degrees, 4.61 degrees and 16 degrees. Therefore these 3 options serve as the default options of $\alpha_E$ and $\alpha_B$ elevations beneath the eastern and western horizon. Visible sunrise to the visible sunset interpretation: where elevations $\alpha_B$ and $\alpha_E$ are defined from the visible sunrise to the visible sunset in the location of the user taking into account the refraction of the rays of light, the diameter of the sun, the height of the observer above the sea level and the landscape of the surface such as mountains or valleys in the plane of the observer and likewise, as necessary, the weather factors, barometric pressure and temperature.

From this perspective, according to a specific Jewish-Law interpretation, there is a need to fix the middle point of the Jewish-Law Day and Night. In all aforementioned distributions of the complete Solar Day, by setting of the starting and termination points of the Jewish-Law Day and Night, their middle points are self defined, as half the time of the Jewish-Law Day or Night. It is true that the definitions of elevations $\alpha_B$ and $\alpha_E$ are done independently of each other, such that the definitions of the start and termination of the Jewish-Law Day do not have to be symmetric to the zenith relative to the user's horizon (that is, equal degrees of elevations relative to the horizon, at the start and at the termination of the Jewish-Law Day). In these cases the moment of time of the middle of the Jewish-Law Day shifts from the midday of the astronomical day—the zenith point. This constitutes a problem for certain applications of the Timer which shall be hereinafter set out.

One of the solutions is the division of the Jewish-Law Day and Night each on its own into two parts of temporal hours defined for each part separately. The first half of the Jewish-Law Day is defined from the moment $T_B$ until the moment of the astronomical midday (the zenith), and the second half of the Jewish-Law Day is defined from this moment until the end of the Jewish-Law Day $T_E$. Likewise, the Jewish-Law Night is divided into two parts, the first part of the Jewish-Law Night is defined as of moment $T_E$ until the moment of the astronomical midnight (the nadir), and the second part of the Jewish-Law Night begins from this moment until the start of the following day $T_B$. The astronomical midday and midnight are defined according to the Diurnal Arc and shall be calculated by the algorithm $\Phi_{sun}$ in the following way: The midday moment $T_{MD}=\Phi_{sun}(Z)$ and the midnight moment $T_{MN}=\Phi_{sun}(M)$. In this case the user should add to the Timer the "midday fix" setting definition.

Calculation of the Temporal Hours Rhythms

The Jewish-Law Day and Night are defined in the present invention as intervals of time having of 12 temporal hours each, therefore we will define the temporal hour as follows: The length of a temporal hour in the course of a Jewish-Law Day in units of standard conventional time is equal to the length of the Jewish-Law Day that is moment $T_B$ less moment $T_E$, divided by 12 hours.

To the extent that the Jewish-Law Day and Night are divided into halves as set out above, the length of the temporal hour in the first half of the Jewish-Law Day will be the moment $T_{MD}$ less moment $T_B$ divided by 6 hours. Likewise, the temporal hours in the course of the Jewish-Law Night will be defined relative to the moment $T_{MN}$ which is the middle point of the Jewish-Law Night.

From this perspective, the aforementioned intervals of time will constitute the rhythm of one temporal hour in the Jewish-Law Timer, from which are derived the secondary time intervals: the temporal minute which is 1/60 of the temporal hour and the temporal second which is 1/60 of the temporal minute, as defined in the standard timer (clock). However, an additional division is displayed in the Jewish-Law Timer and that is the division of the temporal hour into 1080 parts, such that one part of the temporal hour corresponds to 3⅓ temporal seconds. It is possible to display both divisions simultaneously, or only one of them. Likewise, any other division of the temporal hour to a number of parts in accordance with Jewish-Law interpretations requirements is also possible.

Turning to the distribution of the Jewish-Law Day in relation to a 24 Hour Conventional Day, when the Jewish-Law Day and Night have been defined according to the Diurnal Arc, and to the extent necessary we have established the middle of the Jewish-Law Day and/or Night, we have in our hands the starting, middle and termination times of the Jewish-Law Day and Night in the course of a complete 24 hour conventional day, such that on a given date and time in any position on earth, it is possible to point out these particular times in relation to a 24 hour conventional day.

Figure 3:
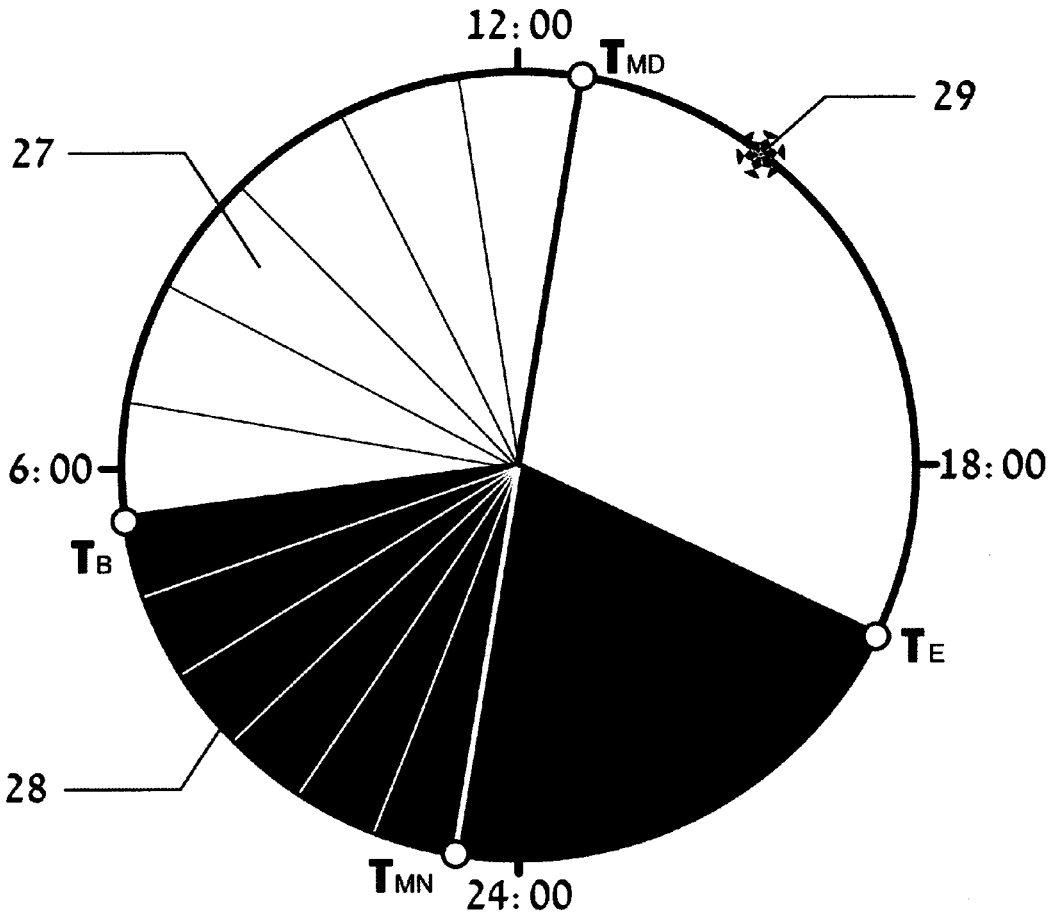
FIG. 3—demonstrates a distribution of nonlinear time, relative to a standard conventional day of 24 linear hours.

FIG. 3 illustrates the distribution of the Jewish-Law Day in relation to a complete 24 hour conventional day in a dial of 24 standard (equals) hours. The conventional day begins at hour 24:00 in the bottom of the hour dial, hour 6:00 is located to the left, hour 12:00 is at the top of the dial and hour 18:00 is located to the right of the dial.

In this figure the example of a typical Jewish-Law Day is on Jun. 6, 2008 in Jerusalem longitude 35.22° north, latitude 31.78° east, on which the Jewish-Law Day begins with the sunrise at 5:32 (standard time) and ends with the sunset at 19:44 (standard time) the middle of the day 12:38 (standard time) and the middle of the night is 00:38 (standard time).

The white and black areas are the time distribution of the Jewish-Law Day and Night in relation to the standard conventional day. The length of the temporal hour in the course of the Jewish-Law Day is 71 minutes and in the course of the Jewish-Law Night 49 minutes. The second half of the Jewish-Law Night and the first half of the Jewish-Law Day [27] are visibly divided into temporal hours, one can see that the division is linear (in other words, equal time intervals in each section), but the length of each temporal hour in the course of the day is greater than the length of the temporal hour in the course of the night.

It is possible to see that the moment of the middle of the astronomical day and night are not at the conventional hour 12:00 but are shifted from it. The asterisk [29] indicates the current standard hour of the user in this example, which is 14:30. In this case we will note that at the end of the Jewish-Law Night, the beginning of the next Jewish-Law Day is recalculated, and will be $T_B'$ so that the distribution of the next Jewish-Law Day and Night (Solar Day) does not fully match to the distribution of the previous Jewish-Law Day and Night in relation to a conventional 24 hour day.

Adaptation of the Temporal Hours to the Standard Timer

At this stage we have in our hands the moment of the start and the moment of the termination (and to the extent necessary the middle) of the Jewish-Law Day and Night in a conventional 24 hour day, these points of time divide the conventional day into the Jewish-Law Day and Night corresponding to the astronomical day as set out above, as well as the length of the temporal hours in relation to an equivalent hour in conventional time, and accordingly the rhythms of the temporal hours.

It is worthy to emphasize that the structure of the standard timer is preserved in the present Jewish-Law Timer, that is the division into 12 hours, 60 minutes and 60 seconds. Such that the hour 12:00 is situated at the top of the dial of hours, at an angular distance of 30° the hour 1:00 is situated, the hour 6:00 is the middle of the day, situated at the bottom of the dial of hours, likewise the minutes and seconds are at an angular distance of 6° equally, as set out above, see FIG. 6 [4].

In the case where the user chooses the division of the temporal hour to 1080 parts as customary in a certain Jewish-Law interpretation, the second hand will move 20° in each portion. The synchronization of the hands to display the temporal hours in the Jewish-Law Timer is done in two stages as described below.

Turning to the Synchronization of the Zero Hour to the Dial of Hours, the Jewish-Law Timer sets the moment of time $T_B$ which is the start of the Jewish-Law Day, to the top of the dial of hours. This position is hour 12:00, the point of origin, and will hereinafter be referred to as the "Zero-Hour".

At the termination moment of the Jewish-Law Day, which is also the moment of the start of the Jewish-Law Night, a synchronization to the Zero-Hour of the Jewish-Law Night is in any case done, such that the position of the Zero-Hour on the dial of hours whether of the Jewish-Law Day or of the Jewish-Law Night is the same.

Turning to Synchronization of the Temporal Hours Rhythms to the Timer, from the Zero-Hour and following in the course of the Jewish-Law Day, the rhythms of the Jewish-Law Timer are the rhythms of the daily temporal time intervals, that is: temporal hours, minutes and seconds of the Jewish-Law Day such that the hour hand will move one temporal hour that is 30° from the Zero-Hour, and the minute hand will move one temporal minute of 6°, and the second hand will move one temporal second of 6° and all this according to the relative movement of the hands as customary in a standard dial timer (hands clock). In this manner, the Timer will move 12 daily temporal hours until the moment of its termination $T_E$, which is also found on the Zero-Hour position as aforementioned.

And in this way the synchronization of the Jewish-Law Night to the Timer is done; at the termination of the Jewish-Law Day, the rhythms of the temporal hours change to the rhythms of the temporal hours of the following Jewish-Law Night.

Following a full cycle of the hour hand until its return to hour 12:00, the timer shows the moment of termination of the Jewish-Law Night $T_B'$ which is also the start of the next Jewish-Law Day as mentioned above, according to the data of the Diurnal Arc of the next day and so on and so forth every day.

In the event that the Jewish-Law Day and Night are divided into halves, the rhythms of time will change accordingly, to indicate the temporal hours synchronized to the particular half. Here too, the display of the hands on the temporal hour will not be different from the display of conventional time that is: 30° per hour and 6° per minute and per second as stated above and as customary in a standard dial timer.

Turning to means of showing time, the preferred display of time in the Jewish-Law Timer corresponds to the preferred display of time in the standard dial timer that is hour, minute and second hands. It being true that it is possible to realize the Jewish-Law Timer also by way of the one main hand only, and it may itself be in the form of a hand [1] or an icon [3] on the dial of hours see FIG. 6. Likewise it is possible to use secondary hands to indicate minute and second intervals as well as other portions of time defined in the Jewish-Law Timer, and even those may be indicated on the dial of hours.

Turning to additional adaptations of the dial of hours and its character, the Jewish-Law Timer can undergo several additional adaptations in order to present the Jewish-Law time in the manner preferred by the user. The Jewish-Law Timer can position the Zero-Hour on any location on the face of the dial of hours that is, right or left and at any other angle.

Likewise, the order of numbering of the hours from the Zero-Hour and following need not be a standard configuration from number 12 and then 1, 2, 3, back to 12, it is also possible to fix the Zero-Hour of the Jewish-Law Timer to show a number or a letter and any other order of numbering, provided that from one Zero-Hour to another, 12 temporal hours will pass whether during the Jewish-Law Day or the Jewish-Law Night.

Furthermore, according to the preference of the user it is possible to change the direction of the numbering on the dial of hours to counter-clockwise as well as the motion of the hands, and this to correspond to languages whose reading direction is from right to left.

Figure 6:
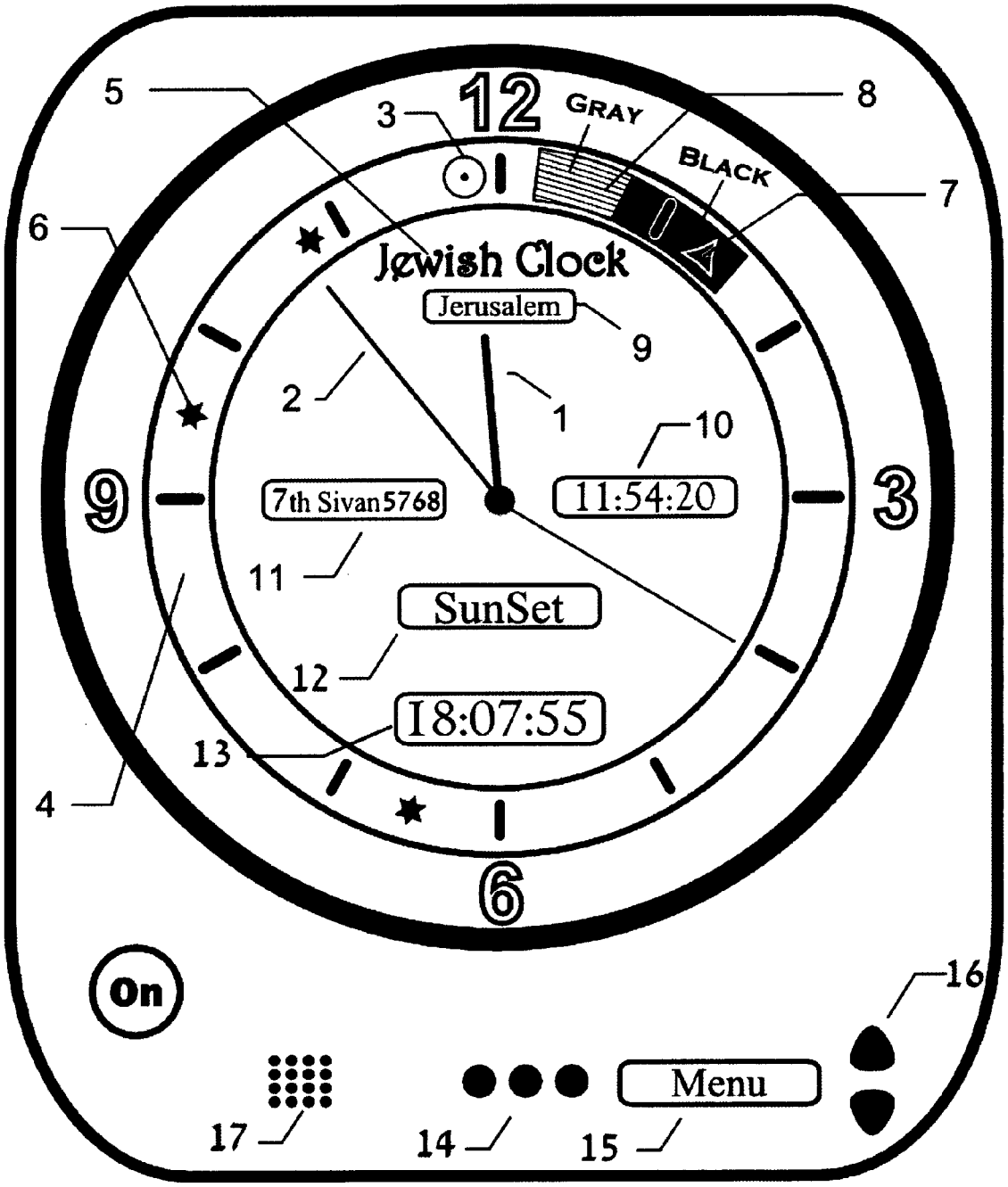
FIG. 6—is a schematic form of a Jewish clock, which is a particular embodiment of the Nonlinear Timer, having a temporal model based on temporal hours.

The Jewish-Law Timer, see FIG. 6 is portrayed in a dial of 12 equal hours. It is true that a display of 24 hours is possible in a standard timer, and such a division is also possible in the Nonlinear Timer. The adaptation of temporal hours to a display of 24 hours is done in such a way that half of the dial of hours shows the Jewish-Law Day and the second half shows the Jewish-Law Night independently of each other, although both appear on the same dial, so that in each half, the length of the temporal hours intervals are re-synchronized.

Background Layers

A strength of the Jewish Law Timer is also evident in the Background Layers. There are related periodic daily events that are connected to the Jewish way of life. These events are either directly dependent on Jewish-Law times, or on the course of the sun in the sky. The Jewish-Law Timer is synchronized specially to display these events in a catchy user-friendly manner, and same by placing icons (symbols) and coloring arcs on the dial of hours which indicate Jewish-Law times in the Background Layer of the Timer, such that by the movement of the hour hand it will be apparent to the user when each event will occur in a tangible manner and in real time. The Background Layer can be situated above or below or integrated with the display of the hands. Since there are events that occur during the Jewish-Law Day and events that occur during the Jewish-Law Night, each Background Layer has 2 separate displays, one for the Jewish-Law Day and one for the Jewish-Law Night.

Two types of events which make up the Background Layers, these events that are displayed in the various of background layers are divided into two types: Static Events—These events are defined according to fixed temporal hours, which do not change in the course of the year. These events will appear on the Timer in a permanent location. Dynamic Events—These events are re-synchronized daily to the temporal hours. These events appear in a given area on the dial of hours however their exact location changes from day to day on the Background Layer of the Timer.

Turning to types of Dynamic Events: These events are defined in temporal hours of the Jewish-Law Day and Night according to a given Jewish-Law interpretation, or according to a given set of elevation angles of the sun on the Diurnal Arc. The combination of Jewish-Law events chosen by the user to be presented on the Timer, are preferably displayed in a single Background Layer which displays them according to the user-default Jewish-Law interpretation of the Day and Night. And same in order to present a specific event defined in a fixed temporal hour, but which occurs in a different standard conventional time, depending on the interpretation of the Jewish-Law Day and Night.

For example the event of the end of the morning Jewish prayer "Shacharit prayer" is at the temporal hour 4:00 in all Jewish-Law interpretations. In fact, in the Jewish-Law interpretation of the visible "sunrise to sunset" Day, and in the interpretation of the "dawn to nightfall" Day, the temporal hour 4:00 occurs in different standard conventional times that are 8:22 for the first and 9:05 for the latter. The user of the Jewish-Law Timer wants to know simultaneously whether the time of this event has arrived according to either interpretation, and does not wish to change the settings of the Timer every time. Accordingly, it is necessary to synchronize these events to the default setting of the temporal hours of Timer.

The method of Synchronization of Dynamic Events to the Temporal Hours, is based on the common denominator which exists amongst the dynamic events and that is the standard conventional time at which the event occurs. This is done in 4 stages: In the first stage the standard conventional time at which the dynamic event occurs is calculated. In the second stage the section of the Jewish-Law Day and Night where the event occurs is determined. (That is, either the Jewish-Law Day or the Jewish-Law Night).

In the third stage the standard conventional time which has passed from the start of the period of the Jewish-Law Day/Night ($T_B$, $T_E$) in which the event is defined, until the moment of its occurrence is calculated. In the last stage the ratio between the time that has passed to the length of the given Jewish-Law Day or Night (on which the event occurs) is calculated. This ratio is multiplied by 12 hours, the result constitutes the amount of temporal hours which have gone by from the beginning of the Jewish-Law Day or Night until the moment the given dynamic event occurs. From this perspective it is apparent that it is possible to synchronize every event that takes place in standard conventional time to the temporal hours to which the Jewish-Law Timer has been set. Such that the definition of dynamic events extends to all of the events that are defined in standard conventional time.

Turning to integration of different Background Layers in the Jewish-Law Timer, it is possible, if desired, to combine several types of different Background Layers simultaneously on the face of the Timer, in order to display multidisciplinary information simultaneously. Likewise, it is possible to present only part of the events in any of the different Background Layers. It is up to the user to set the Background Layers and the events he wishes to display.

In the aforementioned embodiment of the Jewish-Law Timer, the marking of static events is done by asterisk; the marking of dynamic events is done by triangle. See FIGS. 4-6.

The Jewish Prayer Background Layer. For the Jewish people it is an obligation to pray 3 prayers a day: Morning prayer "Shacharit", afternoon prayer "Mincha" and evening prayer "Arvit". For Mincha prayer there are 3 possible times. These prayers are static or dynamic events by definition, and accordingly can be displayed in the Background Layer of the Jewish-Law Timer. Likewise, for the Jewish people it is an obligation to read the "Hear O Israel" portion of the Bible at its required time twice a day, as part of the morning and evening prayers, of the Jewish-Law Day and Night as set by the user of the Timer.

In the Jewish-Law Day Background Layer the abovementioned events will be defined as follows: The morning prayer which includes the "Amida" prayer whose time according to Jewish-Law is from sunrise until the end of the fourth hour of the Jewish-Law Day; The duty to read the "Hear O Israel" portion as part of the "Shacharit" prayer at its required time is up until the third hour of the Jewish-Law Day; The middle of the Jewish-Law Day is always the sixth hour; And the "Mincha" prayer which occurs in the afternoon of the Jewish-Law Day at three main times—"Big Mincha" from 6:30 PM, "Small Mincha" from 9:30 PM and the "Plag of Mincha" from 10:45 PM of the Jewish-Law Day, until its end, usually at the setting of the sun. All of these events are static in the Background Layer of the Jewish-Law Timer because they are set according to Jewish-Law time only.

One of the widespread optional interpretations of the Jewish Jewish-Law Day is from visible sunrise to visible sunset, and in accordance therewith the Jewish-Law Night will be set from visible sunset to visible sunrise of the following day which completes the Jewish-Law Day to a full solar day.

In the Background Layer of the Jewish-Law Night the above-mentioned events will be defined as follows: The evening prayer "Arvit" from the sunset to midnight; the reading of the "Hear O Israel" portion as part of the evening prayer, from nightfall where the stars are visible (there are those who fix this time as 18 temporal minutes, and there are those who fix it as 72 temporal minutes, after the sunset such that it is a static event). Another method of setting the nightfall is based on the conversion of temporal minutes to the position of the sun in degrees beneath the horizon in the epoch of the vernal equinox, such that the $18^{th}$ minute after sunset is defined as 4.6° degrees and the $72^{nd}$ minute after sunset is translated to 16° degrees below the horizon, such that they are dynamic events, varying from day to day as set out above. Midnight is hour 6:00 of the Jewish-Law Night. The moment of the dawn is defined as 72 minutes before the sunrise. There are those who fix it in temporal minutes such that it is a static event and those who fix it according to the abovementioned elevation generally 16° below the horizon such that it is a dynamic event. We note that there are multiple methods for setting the Jewish prayers, as well as multiple definitions of the elevation angles of the aforementioned events. Such that we do not purport here to determine the Jewish-Law on the issue, rather with G-d's help we have devised a tool which enables the indication of the Jewish hour in the spirit of the Jewish-Law interpretation, and same according to the setting of the individual user.

Figure 4:
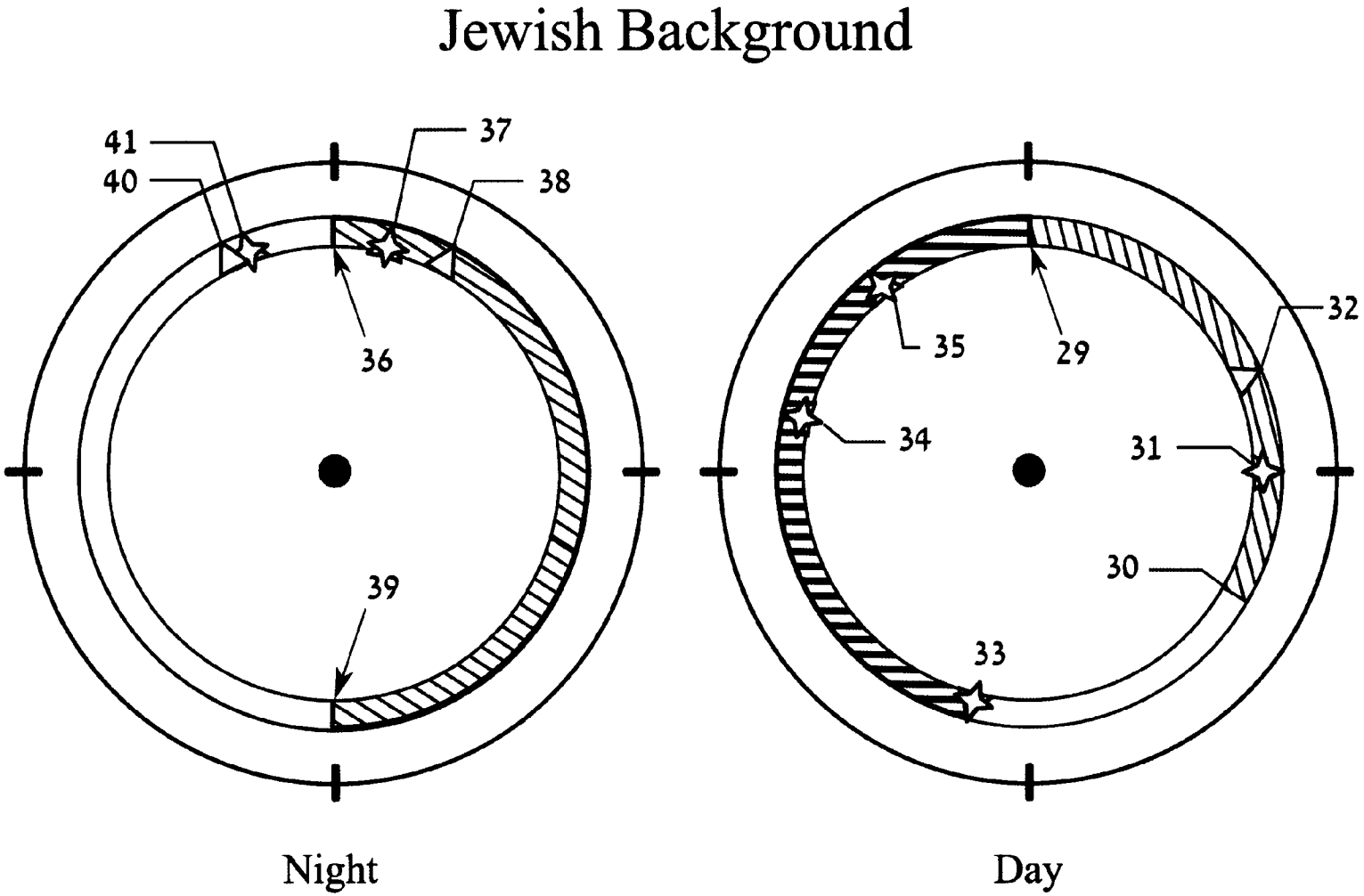
FIGS. 4, 5—demonstrate how icons (symbols) are situated by the Nonlinear Timer in its background in order to indicate particular events in accordance with the Nonlinear temporal model being used by the Timer.

FIG. 4 illustrates the Jewish Background Layer for the Jewish-Law Timer according to the distribution described above. The day Background Layer begins with the sunrise [29] as of which the morning prayer "Shacharit" can take place, that is until the fourth hour [30]. The third hour is the end of the time for reading the "Hear O Israel" portion [31], and it is a static event. As for the interpretations which divide the Jewish-Law Day from "dawn to nightfall" the third hour ends earlier, than in the "sunrise to sunset" interpretation and varies from day to day and is therefore a dynamic event [32]. The afternoon prayer "Mincha" takes place from hour 6:30 [33] until sunset [29]. The moment of "small Mincha" [34] and the "Plag of the Mincha" [35] occur at fixed time as aforesaid, and are therefore indicated by an asterisks.

The night Background Layer begins with the sunset which also indicates the moment of the beginning of the evening prayer "Arvit" [36] which ends at midnight [39] and which is also the hour 6:00. Two times which indicate the nightfall are marked: 18 temporal minutes after the sunset is marked with an asterisk [37] and the $72^{nd}$ minute in the vernal equinox which is 16° degrees below the horizon is marked by a triangle [38]. Likewise two times of the dawn are indicated in this Background Layer: 72 temporal minutes prior to the sunrise of the next day [41] and 16° degrees below the horizon [40].

Muslim Prayer Background Layer, it is possible to realize with the Nonlinear Timer, in a similar way to the Jewish-Law Timer, a Muslim Timer. For the Muslim nation there are five obligatory prayers in the course of the day: the dawn prayer "Faj'ar", the noon prayer "Zah'ar", the dusk prayer "Ass'ar", the sunset prayer "Mag'rav" and the night prayer "Ayish'aa". These prayers are static or dynamic events by definition and are dependent on the daily motion of the sun across the Diurnal Arc. Turning to one of the distributions of the solar day in the Muslim prayer Background Layer, the Muslim calendar day begins with the beginning of the "Muslim Day" and ends with the "Muslim Night". The Muslim Day: is defined as from dawn to the visible sunset. The Muslim Night: is defined as from the visible sunset of the present day until dawn of the following day.

Figure 5:
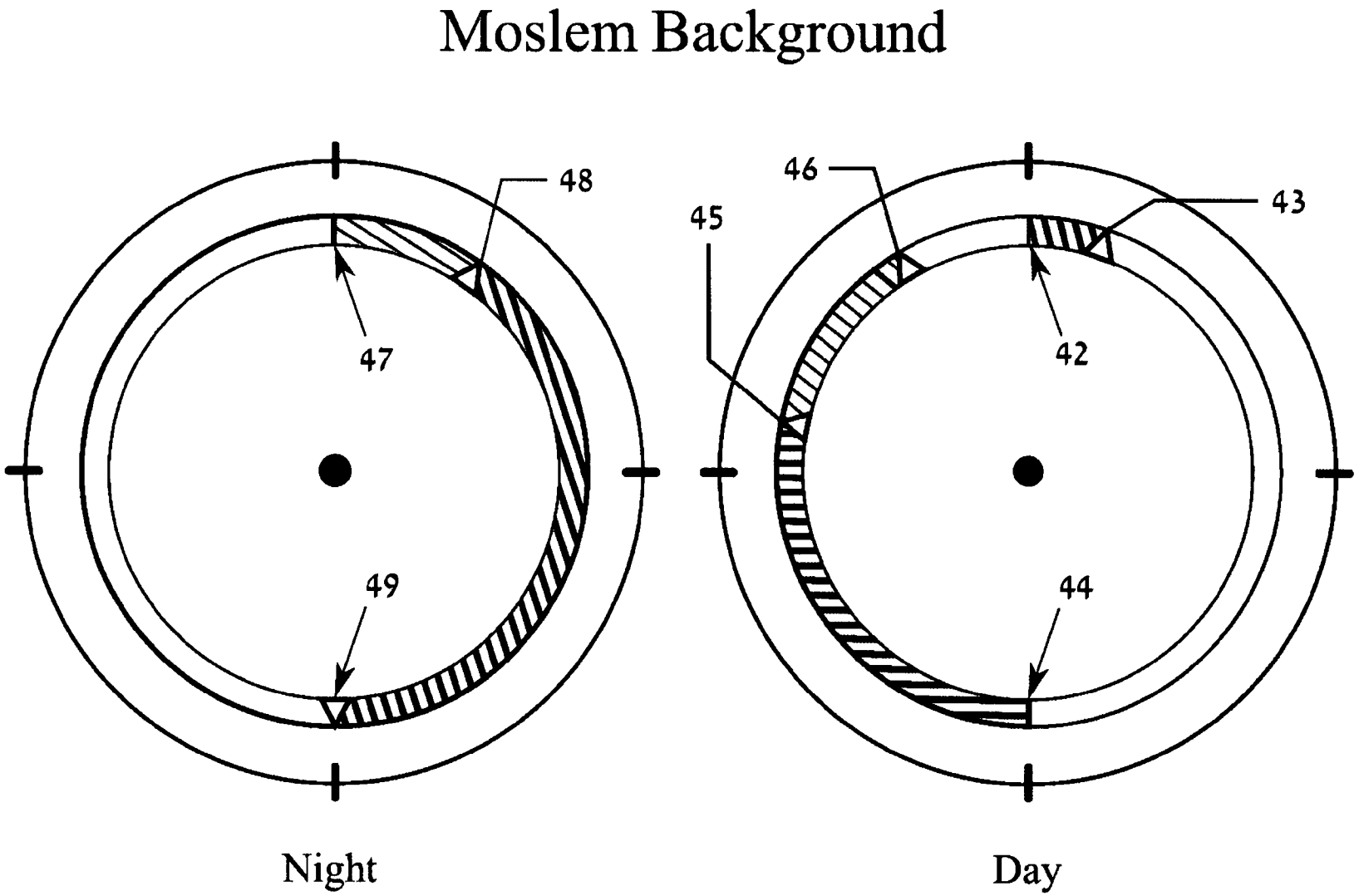

FIG. 5 illustrates the Background Layer of the Muslim prayer displays in a nonlinear time model belonging to the Islamic culture. In the Muslim Day Display the Faj'ar prayer (dawn) is shown [42-43] this prayer is defined from dawn until the visible sunrise. According to various Islamic schools of thought dawn ranges from when the sun is located between 15-20 degrees below the horizon and the user is required to choose the Muslim definition which is most appropriate for him. The end of the Faj'ar prayer is at the visible sunrise. In the midday the Zah'ar (noon) prayer is shown [44-45] this prayer is defined from the minimal shade (midday) the hour 6:00 until the beginning of the Ass'ar prayer. Towards the end of the Muslim Day the Ass'ar (afternoon) prayer is shown [45-46] this prayer is defined according to the length of the shadow of a rod positioned against the sun, therefore by elevation of the sun on the Diurnal Arc, where the length of the shadow of the rod (discounting the length of the shadow of the midday), are equal to one another. The user of this Muslim Timer will be able to set the Timer according to the school of thought of the "Hanafi" or of the "Shafi" and so on which define the length of the shadow differently in respect of this prayer. The "Ass'ar" prayer ends close to the sunset hour, 12:00.

In the Muslim Night display the "Mag'rav" (evening) prayer is shown [47-48] this prayer is from the visible sunset hour 12:00 until the "Ayishaa" prayer. The "Ayishaa" night prayer is shown [48-49], this prayer is defined from nightfall (according to the different Islamic schools of thought by elevation of the sun below the horizon between 15-20 degrees), until midnight or until the "Faj'ar" prayer of the following day. It is up to the user to choose which Muslim definition is most appropriate for him.

As stated above, the Timer allows the user individual freedom to adjust the settings of the nonlinear time model implemented by the Nonlinear Timer, to the individual needs, spirit and personal beliefs.

Application of the Jewish-Law Timer in the Nonlinear Timer

FIG. 6 is a prototype of the Jewish-Law Timer. This Timer is similar to a standard timer in its shape and in its hands, however as aforementioned it is tailored to the temporal hours of the Jewish-Law model. In this way the hands of the timer [1-2] are guided by different rhythms, likewise, an additional indicator for showing time [3] moves on the dial of hours itself [4] in order to show time in a more concrete way.

Parallel to the hands of the Timer, is the Jewish-Law Background Layer [5]. Events that are displayed in this Background Layer are partly static events [6] marked by an asterisk and partly dynamic events marked by a triangle [7]. Events that occur during a greater period of time are indicated by coloring segments of the arcs in different colors on the dial of hours [8]. The Timer shows the temporal hour 11:54 of the Jewish-Law Day (at approximately 5 minutes before the sunset in this case).

The static events indicate the afternoon prayer "Mincha" and the arcs of time indicate the dusk time and the period of the afternoon twilight, lasting until the astronomical nightfall, 18 degrees below the user's horizon. The triangle indicates the nightfall according to a particular interpretation of the Jewish-Law, at this moment as mentioned above, one can read the "Hear O Israel" portion of the Morning Prayer at its right time.

This embodiment of the Timer includes alpha-numeric displays [9-13] to show: the location of the user of the Timer; the present temporal hour in a digital manner; the Hebrew date; the event which is due to occur in the near future; and the standard conventional hour.

The input stage of the prototype [14-16] includes a digital display and buttons which enable the selection of different menus in order to set the time, the place, the location, the conventional Gregorian date of the user, and to choose the nonlinear model of the Jewish-Law interpretation personally appropriate to the user. (This model contains the Jewish-Law Day and Night definitions as set out above in the "The Definition of the Jewish-Law Day and Night" section.) To the extent necessary it is possible to define advanced settings of the different interpretations of the Jewish-Law Day and Night such that the model will be accurately adapted to the desired Jewish-Law model and to the option to fix the aforementioned astronomical midday. Further, it is possible to set options for secondary intervals (such as 1080 parts per hour), for the shape of the hands or the direction of their movement (clockwise/counter-clockwise) and for the numbering of hours as described in the "Additional Adaptations of the Dial of Hours and its Character" section. The input stage allows the user to choose from a list of Background Layers, the particular Background Layer which suits him and even to change the events set in the given Background Layer in order to adapt them to his Jewish-Law model. For example he could define the event "end of the time for the morning prayers" according to any Jewish time interpretation, or to a particular location of the sun in the Diurnal Arc and even to time shifts from these moments. The Timer performs the required adjustment thereafter in order to adapt these times into the Jewish-Law default model according to which the Timer is functioning as set out in the "Synchronization of Dynamic Events to the Temporal Hours" section.

It is possible to simultaneously set a combination of the Background Layers such as the Jewish-Law Model Background Layer and a "Healthy Model Background Layer". It is also possible to set a warning signal with respect to specific events by way of the non-frontal output [17]. In this case for example, a tone is set to ring 5 temporal minutes prior to the end of the time for reading the "Hear O Israel" portion. Furthermore, it is possible to realize the input stage of the Jewish-Law Timer in many other ways including by connection to an external computer containing an appropriate program for the Jewish-Law Timer in all its aforementioned settings, or to transfer data from one Timer to another, and same by way of wire or wireless connections and even to receive data from local communication networks including cellular phone networks.

In these respects, it is to be understood that the invention is not limited in its application, to the details of construction, nor to the arrangements of the components, nor the nonlinear models set forth. Furthermore while the invention has been described with respect to specific examples including presently preferred modes of carrying out the invention, those skilled in the art will appreciate that there are numerous variations and permutations of the Nonlinear Timer apparatus described systems and techniques that fall within the spirit and scope of the invention as set forth in the appended claims.

I claim:

1. A Nonlinear Timer apparatus comprising:

(A) an electronic processor running a predetermined program, said processor having (i) an internal clock configured for producing evenly paced signals, (ii) an input stage capable of accepting a geographical position calibration and a calendar calibration and a clock calibration, and (iii) a calculator stage capable of real-time calculating at least one respective current temporal interval using the internal clock in conjunction with the calibrations of the input stage; and said calculator stage includes computation of a display indicator velocity component and (B) a displayer interconnected to the processor, said displayer having (i) a display driver stage capable of modifying a display setting using the at least one respective current temporal interval and the display indicator velocity component, and (ii) a presentation stage capable of presenting a respectively modified display setting.

2. The apparatus according to claim 1 wherein the input stage capable of accepting a geographical position calibration includes a user interface accepting at least one data item selected from the list: a nearest city, a country, a GMT related time zone, a latitude, a longitude, and a Global Positioning System signal.

3. The apparatus according to claim 1 wherein the input stage capable of accepting a calendar calibration includes a user interface accepting at least one data item selected from the list: a national calendar date, a religious calendar date, a cultural calendar date, a personal biological calendar date, an agricultural calendar date, a species specific physiological calendar date, a weather event calendar date, an econometric model calendar date, and a predetermined interpretation of any of the aforesaid.

4. The apparatus according to claim 1 wherein the input stage capable of accepting a clock calibration includes a user interface accepting at least one data item selected from the list: a GMT correlated clock reading and another Nonlinear Timer apparatus correlated clock reading.

5. The apparatus according to claim 1 wherein the calculator stage computation of display indicator velocity components is configured to include a non-zero acceleration for substantially any contiguous intermediate plurality of said respective indicator velocity components.

6. The apparatus according to claim 1 wherein the displayer presentation stage includes a display module selected form the list: flat digital display, rotating analog indicator, and a combination of the aforesaid.

7. The apparatus according to claim 6 wherein the displayer presentation stage includes a display module configured to display at least one item selected from the list: an icon, an alert, an alarm, and a reminder; and the location of each respective at least one item is positioned in coordination with an orientation of a visible indicator.

8. The apparatus according to claim 1 wherein the calculator stage includes parameters of a predetermined substantially non linear temporal model and said parameters are used in the real-time calculating.

9. The apparatus according to claim 1 wherein the display indicator velocity component is a real time computed quantity of the evenly paced signals.

10. A Nonlinear Timer apparatus comprising:

(A) an electronic processor running a predetermined program, said processor having (i) an internal clock configured for producing evenly paced signals, (ii) an input stage capable of accepting a geographical position calibration and a calendar calibration and a clock calibration, and (iii) a calculator stage capable of real-time calculating at least one respective current temporal interval using the internal clock in conjunction with the calibrations of the input stage; and (B) a displayer interconnected to the processor, said displayer having (i) a display driver stage capable of modifying a display setting using the at least one respective current temporal, interval, (ii) a presentation stage capable of presenting a respectively modified display setting, and (iii) a display indicator with a large plurality of respectively contiguous perceived velocities.

11. The apparatus according to claim 10 wherein the input stage capable of accepting a geographical position calibration includes a user interface accepting at least one data item selected from the group consisting of a nearest city, a country, a GMT related time zone, a latitude, a longitude, and a Global Positioning System signal.

12. The apparatus according to claim 10 wherein the input stage capable of accepting a calendar calibration includes a user interface accepting at least one data item selected from the group consisting of a national calendar date, a religious calendar date, a cultural calendar date, a personal biological calendar date, an agricultural calendar date, a species specific physiological calendar date, a weather event calendar date, an econometric model calendar date, and a predetermined interpretation of any of the aforesaid.

13. The apparatus according to claim 10 wherein the input stage capable of accepting a clock calibration includes a user interface accepting at least one data item selected from the group consisting of a GMT correlated clock reading and another Nonlinear Timer apparatus correlated clock reading.

14. The apparatus according to claim 10 wherein the displayer presentation stage includes a display module selected from the group consisting of a flat digital display, rotating analog indicator, and a combination of the aforesaid.

15. The apparatus according to claim 14 wherein the displayer presentation stage includes a display module configured to display at least one item selected from the group consisting of an icon, an alert, on alarm, and a reminder; and the location of each respective at least one item is positioned in coordination with an orientation of a visible indicator.

16. The apparatus according to claim 10 wherein the calculator stage includes parameters of a predetermined substantially non linear temporal model and said parameters are used in the real-time calculating.

17. The apparatus according to claim 10 wherein the indicator is configured to include predetermined non-zero acceleration for substantially any contiguous intermediate plurality of the respective indicator velocities.

18. The apparatus according to claim 10 wherein the perceived velocities are respective rates of change from one display indicator position to a next display indicator position.

19. The apparatus according to claim 10 wherein the perceived velocities are respective rates of change from one digital presentation next digital presentation.

* * * * *